US010959579B1

(12) United States Patent
Sotos

(10) Patent No.: US 10,959,579 B1
(45) Date of Patent: Mar. 30, 2021

(54) UTILITY WASH CLOTH

(71) Applicant: Demetrios C Sotos, Chicago, IL (US)

(72) Inventor: Demetrios C Sotos, Chicago, IL (US)

( * ) Notice: Subject to any disclaimer, the term of this patent is extended or adjusted under 35 U.S.C. 154(b) by 0 days.

(21) Appl. No.: 16/587,992

(22) Filed: Sep. 30, 2019

Related U.S. Application Data

(63) Continuation-in-part of application No. 15/366,302, filed on Dec. 1, 2016, now Pat. No. 10,478,021.

(60) Provisional application No. 62/276,921, filed on Jan. 10, 2016.

(51) Int. Cl.
*A47K 7/02* (2006.01)
*A47L 13/16* (2006.01)

(52) U.S. Cl.
CPC ..... *A47K 7/02* (2013.01); *A47L 13/16* (2013.01)

(58) Field of Classification Search
CPC ..... A47K 7/02; A47K 7/04; A47K 25/005; A47L 25/005; A47L 13/00; A47L 13/16
See application file for complete search history.

(56) References Cited

U.S. PATENT DOCUMENTS

| | | | |
|---|---|---|---|
| 4,523,348 | A | 6/1985 | Petrie |
| 5,326,610 | A | 7/1994 | Moss |
| 5,412,830 | A | 5/1995 | Girardot |
| 5,491,864 | A | 2/1996 | Tuthill |
| 5,545,456 | A | 8/1996 | Suda |
| 5,916,586 | A | 6/1999 | Villa |
| 5,983,435 | A | 11/1999 | Osborne |
| 6,026,534 | A | 2/2000 | Gonda |
| 6,085,380 | A | 7/2000 | Gonda |
| 6,305,431 | B1 | 10/2001 | Fenkes |
| 6,656,565 | B2 | 12/2003 | Harrison |
| 6,694,563 | B2 | 2/2004 | Onwugbonu |
| 7,244,884 | B2 | 7/2007 | Beerbohm |
| 7,589,053 | B2 | 9/2009 | Larsen |
| 7,752,702 | B2 | 7/2010 | Nakamura |
| 8,156,967 | B2 | 4/2012 | Huffstickler |
| 8,500,211 | B2 | 8/2013 | Linblad |
| 8,678,044 | B2 | 3/2014 | Rabin |
| 9,267,232 | B2 | 2/2016 | Gilman |
| 2007/0256261 | A1 | 11/2007 | Benitez |

FOREIGN PATENT DOCUMENTS

GB 1132449 A * 10/1968 ..... A46B 5/04

OTHER PUBLICATIONS

Scotch-Brite Stay Clean Product Line; Add for Stay Clean Products [online]. [retrieved on Nov. 23, 2016]. Retrieved from the Internet: <URL: http://www.scotch-brite.com/3M/en_US/scotch-brite/tools/~/Scotch-Brite- Products/Stay-Clean/?N=4337+3292303930+3294529207+3294857497&rt=r3>.

Scotch-Brite Stay Clean Product Line; Scotch-Brite Stay Clean Scrub Sponge; Advertised as won't trap food [online], [Retrieved on Nov. 21, 2016]. Retrieved from the Internet: <URL: http://www.scotch-brite.com/3M/en_US/scotch-brite/tools/~/Scotch-Brite-Stay-Clean-Scrub-Sponge?N=4337+3294529207+3294554039&rt=rud>.

(Continued)

*Primary Examiner* — Shay Karls

(57) ABSTRACT

A reusable handheld cleaning implement comprised of a flat, perforated, semi rigid, pliable, semi resilient backing made of water resistant material. A plurality of single, solid, linear, vertical, soft, pliable, semi resilient, smooth, non-open looped strands are connected to the backing.

18 Claims, 3 Drawing Sheets

(56) References Cited

OTHER PUBLICATIONS

Scotch-Brite Scrubbing Dish Cloth; Advertised as a cloth that rinses clean [online]. [Retrieved on Nov. 21, 2016]. Retrieved from the Internet: <URL: http://www.scotch-brite.com/3M/en_US/scotch-brite/tools/~/Scotch-Brite-Scrubbing-Dish-Cloth?N=4337+3292022350+3294529207&rt=rud>.
http://www.scotch-brite.com/3M/en_US/scotch-brite/tools/~/Scotch-Brite-Scrubbing-Dish-Cloth?N=4337+3292022350+3294529207&rt=rud.
http://www.scotch-brite.com/3M/en_US/scotch-brite/tools/~/Scotch-Brite-Stay-Clean-Scrub-Sponge?N=4337+3294529207+3294554039&rt=rud.
http://www.scotch-brite.com/3M/en_US/scotch-brite/tools/~/Scotch-Brite-Products/Stay-Clean/?N=4337+3292303930+3294529207+3294857497&rt=r3.

* cited by examiner

UTILITY WASH CLOTH

CROSS-REFERENCE TO RELATED APPLICATIONS

This application is a continuation in part of application Ser. No. 15/366,302, filed Dec. 1, 2016. Application Ser. No. 15/366,302 claims the benefit of provisional application No. 62/276,921, filed Jan. 10, 2016.

STATEMENT REGARDING FEDERALLY SPONSORED RESEARCH OR DEVELOPMENT

"Not Applicable"

NAMES OF THE PARTIES TO A JOINT RESEARCH AGREEMENT

"Not Applicable"

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

"Not Applicable"

STATEMENT REGARDING PRIOR DISCLOSURES BY THE INVENTOR OR A JOINT INVENTOR

"Not Applicable"

BACKGROUND OF THE INVENTION

Field of Invention

The present invention pertains to CPC sections A47K7/02 (bathing sponges, brushes, gloves, or similar cleaning or rubbing implements), A47K7/04 (washing or cleaning devices, hand or mechanically operated), A47L25/00 (miscellaneous cleaning devices).

Background Art

The usefulness of the present invention originated from addressing problems found in prior art handheld cleaning implements intended for showering and bathing.

A multitude of hand held cleaning implements have been developed for use during bathing and showering. Natural or synthetic sponges, cotton or microfiber washcloths, loofahs and net sponge-poofs have generally been the most common options. Each of the mentioned prior art implements have a number of deficiencies accompanying their use. Sponges have a form consisting of various openings or pores which attract dirt, soil, skin, and hairs. A sponge's form makes it difficult to rinse the sponge of dirt, soil, skin and hairs after use which decreases or eliminates its reusability. Washcloths have a form that is prone to crumple and bunch up while in use; which reduces its effective surface area, ability to lather and overall ease of handling. A washcloth's form makes it difficult to rinse the washcloth of dirt, soil, skin and hairs after use. Loofahs have a form consisting of various openings or pores which attract dirt, soil, skin, and hairs Prior art U.S. Pat. No. 6,656,565B2 (Harrison). A loofah's form makes it difficult to rinse the loofah of dirt, soil, skin and hairs after use which decreases or eliminates its reusability.

Net sponge-poofs; also referred to as a loofah/luffa, have a form consisting of folded netting which attracts dirt, soil, skin and hairs Prior art U.S. Pat. No. 5,916,586A (Villa). A net sponge-poof's form makes it difficult to rinse the net sponge-poof of dirt, soil, skin and hairs after use which decreases or eliminates it reusability Prior art U.S. Pat. No. 7,589,053B2 (Larsen).

There are a variety of cleaning implements which are described as having both a surface that is soft and a more abrasive surface to exfoliate. These hybrid implements have forms characterized by deficiencies similar to those present in the already mentioned prior art cleaning implements. For example, Prior art U.S. Pat. No. 5,412,830A (Girardot) is a dual textured implement that contains two main elements; a coarse diamond mesh scrim surface and a softer knitted material surface, which when combined form an implement that resembles a netted pouch; resulting in an implement that is more likely to trap soil, dirt, skin and hairs; which is difficult to rinse and reuse.

Prior art U.S. Pat. No. 5,491,864A (Tuthill) is a gathered hydrophobic diamond mesh scrim with circumferential pleats. The disclosure states the invention can be quickly rinsed and dried. It is not clear what the invention can be quickly rinsed of. Based on the invention's form; which resembles a flat batt of netting, it would be difficult to rinse and reuse the described implement. The flat diamond mesh scrim may be easier rinsed of liquids; such as soap, but a gathered diamond mesh scrim with circumferential pleats has a form made up of openings and slots that are difficult to rinse of soil, dirt and hairs.

There are known other prior art cleaning implements. Prior art Stay Clean Scrub Sponge; sold by Scotch-Brite™, is a dual surfaced device. It contains a coarse surface and a sponge surface; and is advertised as a scrub sponge with a surface that will not trap food. The Scrub Sponge's coarse surface does not allow for a comfortable or gentle use during showering and bathing. The sponge surface is porous; whose openings increase in size after each use as the sponge wears down. The sponge surface also does not have desirable drying characteristics. Prior art Scotch-Brite Scrubbing Dish Cloth; also sold by Scotch-Brite™, is advertised as a cloth that rinses clean. It is not clear what the cloth can be rinsed clean of. Based on its slack form, the device would experience deficiencies similar to those demonstrated by any ordinary washcloth. Distinguishing attributes and advantages of the present invention in relation to implements such as the Scotch-Brite Scrub Sponge and Scotch-Brite Scrubbing Dish Cloth will be illustrated and explained in the detailed description of the invention.

BRIEF SUMMARY OF THE INVENTION

A reusable handheld cleaning implement comprised of a mostly flat, perforated, semirigid, pliable, semiresilient backing made of water resistant material. A plurality of single, solid, linear, vertical, soft, pliable, semiresilient, smooth, non-open looped strands are connected to the backing.

An objective of the present invention is to provide a reusable handheld cleaning device demonstrating desirable rinsing characteristics in regards to foreign matter. The spirt of the present invention has a utility that considers multiple uses that may benefit from a comfortable reusable handheld cleaning device with advantageous rinsing attributes.

DETAILED DESCRIPTION OF THE INVENTION

Figure 1:
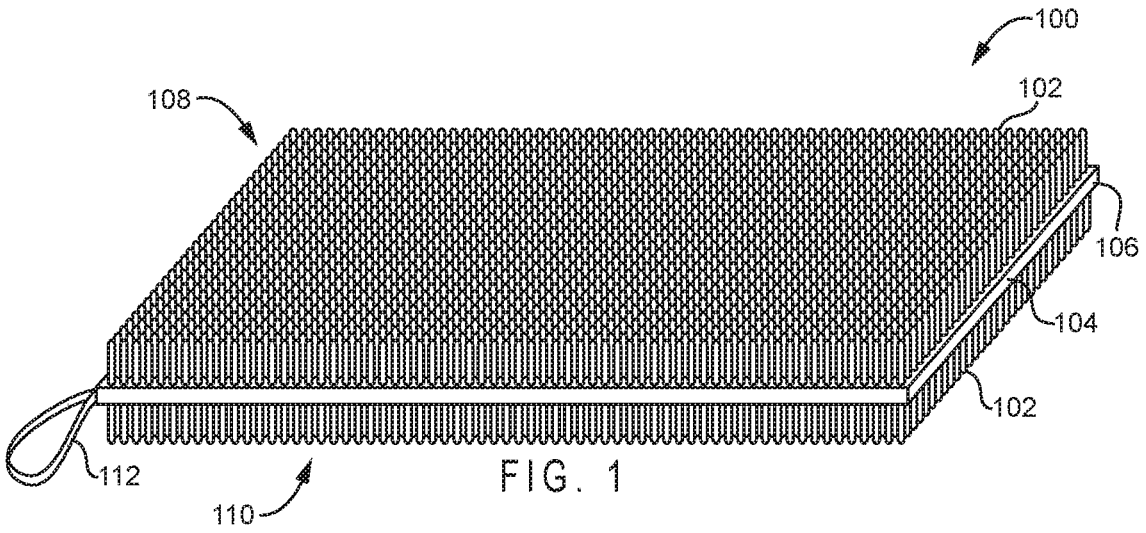
FIG. 1 is a perspective top view of an embodiment of the invention.

Referring now to the drawings in order to better understand the present invention, its objectives, elements, usefulness and advantages.

FIG. 1, there is shown the preferred embodiment of the present invention which provides a reusable handheld cleaning implement and is generally indicated as implement 100. Implement 100 is comprised of backing 104, strand 102, a top surface 108, a bottom surface 110, a perimeter 106 and a tether 112.

Figure 2:
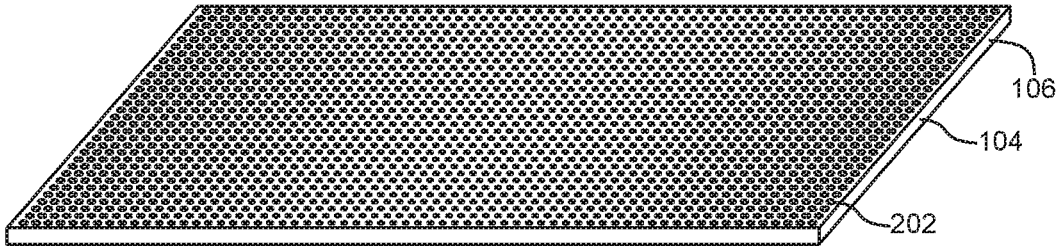
FIG. 2 is a perspective top view of a backing according to the invention.

FIG. 2, there is shown backing 104 of implement 100. Backing 104 is a single nonabrasive piece. More specifically, backing 104 and the backing of alternate embodiments of the present invention exclude a backing made of multiple layers that may create slots, pouches, gloves, mitts or accordion like structures that are contrary to the spirit of the invention; resulting in an implement that is difficult to rinse and reuse Prior art U.S. Pat. No. 5,412,830A (Girardot) & Prior art U.S. Pat. No. 5,491,864A (Tuthill). The backing may be comprised of multiple layers assembled to form a single backing. Backing 104 is mostly flat and constructed to be semirigid, pliable and semiresilient. The described requirements of backing 104 are an essential and fundamental part of the present invention; necessary to solve problems related with prior art washcloths and other slack handheld implements lacking a specific backing member; that are intended for a bathing and showering application. Implement 100 is adequately rigid and resilient; to resist bunching and crumpling as it is casually moved along the applied surface, while also being pliable in order to allow implement 100 to be contoured to the applied surface. The measure or degree of semirigidity and semiresilience are at levels that allow for any ordinary person to bend, flex and operate implement 100 with one hand. The semirigid flat surface of backing 104 minimizes or eliminates folds and pleats; enabling an intended user to hold implement 100 in one hand or place implement 100 on a relatively flat surface and rinse the device of dirt, soil, skin and hairs with water sprayed from a showerhead or hose. The semirigidity of backing 104 also allows for a user to better handle and rinse implement 100 after use by rubbing implement 100 between two hands under running water; as implement 100 resists bunching and crumpling.

Backing 104 is comprised of multiple perforations 202. Perforations 202 are located throughout the backing; adjacent to the strands. Perforations 202 are permeable; allowing air and water to pass through backing 104. More specifically, perforations 202 ensure backing 104 is not watertight. Perforations 202 creating large gaps or openings in backing 104 are not within the scope of the invention. For example, Prior art U.S. Pat. No. 6,656,565B2 (Harrison) incorporates linear openings that are more likely to trap foreign matter such as a hair; which can entangle itself through and around the large openings in the backing, resulting in a device that is difficult to rinse and reuse. Large perforations or openings also produce undesirable results when the invention is used together with a liquid such as body wash. The liquid can more easily drip or pass through the large openings in the backing; not allowing the user and the implement time to produce a lather; causing unwanted waste and negatively influencing the invention's efficacy during a bathing application. Perforations 202 are less than or up to about 1 mm in diameter; and perforations are less than or up to about 5 mm in diameter for alternate embodiments of the present invention. Perforations 202 aid implement 100 in producing a lather as well as improve the implement's overall rinsing and drying traits. When the invention takes the form of this particular embodiment, perforations 202 further increase the usefulness of implement 100 by allowing an efficient amount of water and soap to pass through to the opposite side of the surface being applied; enabling the user to more easily alternate between surfaces during use.

Backing 104 is constructed of a water resistant material as to supplement the semirigidity, pliability and semiresilence of backing 104. A water resistant material benefits backing 104 and alternate embodiments of the present invention by minimizing the change in measure of rigidity, pliability and resilience between a wet or dry application. The backing of the present invention may also be comprised of a waterproof material. A water resistant material also contributes to the behavior of perforations 202; minimizing their fluctuation in size when implement 100 is exposed to liquids. A water resistant material further benefits the present invention in relation to the thickness of backing 104. A water resistant backing that satisfies the semirigidity, pliability and semiresilience requirements of the present invention can be considerably thinner than a backing that is not water resistant. A thin backing minimizes the volume of perforations 202; which further improves the overall ability of implement 100 to be rinsed and reused. A water resistant material also improves the drying qualities of implement 100.

Perimeter 106 and implement 100 are square in shape. Embodiments of the present invention can include rectangular, circular and other geometric shapes. Perimeter 106 has a nonabrasive surface. The present invention excludes a perimeter and shape that is abrasive or has a form constructed with angles that may result in a device that is difficult to rinse and reuse. The dimensions of backing 104, implement 100 and alternate embodiments of the present invention are restricted. For example, common bath towels; which measure approximately 30 inches by 60 inches, are not within the scope of the invention. The size of a bath towel contradicts an objective of the present invention; to be an easily rinsed handheld implement. In addition, the dimensions of a bath towel create too much conflict regarding the balance of semirigidity, pliability and semiresilience to make it an effective and demonstrable handheld cleaning implement within the scope of the invention, Prior art U.S. Pat. No. 8,678,044B2 (Rabin). The dimensions of the present invention are restricted to any combination of a backing and strands that measures a maximum length of about 15 inches and a minimum length of about 3 inches; a maximum width of about 15 inches and a minimum width of about 3 inches; and a maximum diameter of about 1 inch.

Spherical forms are also not within the scope of the invention, Prior art U.S. Pat. No. 6,026,534A (Gonda), due to lacking a flat surface.

The preferred dimensions of backing 104 are 5 inches by 5 inches with a thickness of 1 mm.

Figure 3:
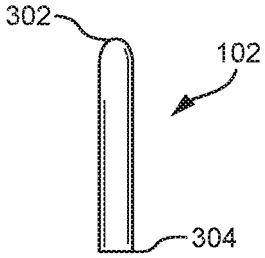
FIG. 3. is a perspective view of a strand according to the invention.
Figure 4:
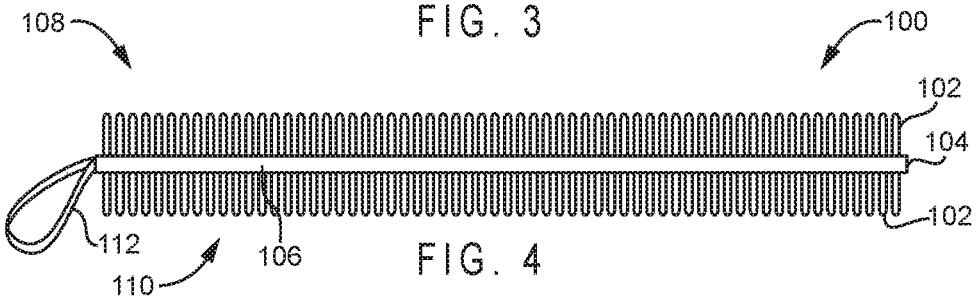
FIG. 4. Is a perspective side view of an embodiment of the invention.
Figure 5:
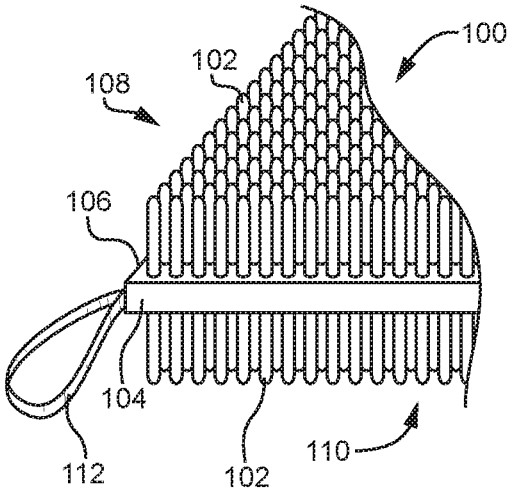
FIG. 5. Is a perspective sectional view of an embodiment of the invention.

FIG. 3, there is shown strand 102 of implement 100. Strand 102 consists of a top end 302 and a bottom end 304. Bottom end 304 is connected to; or extends from, backing 104 and top end 302 is free and unattached.

A plurality of strand 102 comprises both the top surface 108 and the bottom surface 110 of implement 100. Alternate embodiments may include an implement whose perimeter is surfaced with strands. The present invention does not demand any of the surfaces comprising said invention be identical. Embodiments may include implements whose surfaces are not identical. For example, embodiments of the present invention may include a device where only one of the main surfaces is comprised with strands; or a device where any number of surfaces is comprised with an unequal number of strands; and where any of the aforementioned surfaces is comprised of strands that are unequal in measurements and spaced at various unequal distances from each other.

Figure 7:
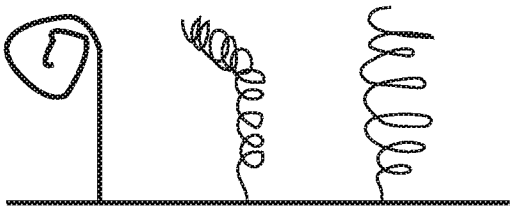
FIG. 7. Is a perspective view of some strands not according to the invention.

Strand 102 is mostly linear; more specifically, not a strand that has a form consisting of bend(s) and or twist(s) that may trap foreign matter FIG. 7. Top end 302 is vertical or vertically aligned to bottom end 304; as to exclude a strand that is horizontally aligned to backing 104; which may create an area between strand 102 and backing 104 that is difficult to rinse, Prior art, U.S. Pat. No. 9,267,232B2 (Gilman).

Figure 8:
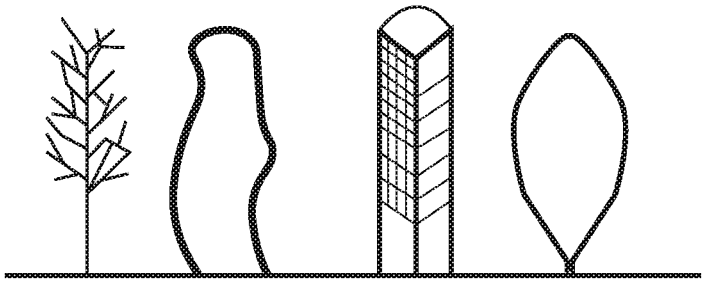
FIG. 8. Is a perspective view of some strands not according to the invention.

Strand 102 is constructed to be a single solid strand and more specifically not an open looped strand. Open looped refers to a strand that consists of an opening or openings. This includes a strand that may have multiple origins from a backing; then those origins loop, connect, mesh, intertwine or cross with each other to form a strand that is not solid; that has a surface made up of openings and slots; similar to a net or a tree and its branches. Such a strand is not within the scope of the invention FIG. 8. Its form creates a surface that clings to skin, dirt, soil, hairs and is difficult to rinse and reuse.

Figure 9:
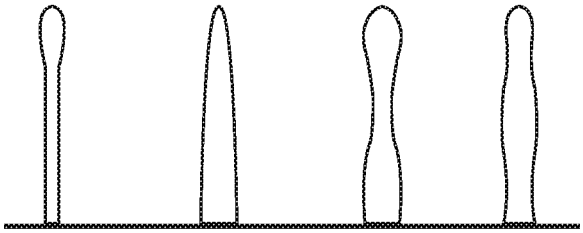
FIG. 9. Is a perspective view of some strands according to the invention.

Strand 102 is constructed to have an overall smooth surface; not consisting of projections or indentations that create a ridged or ribbed surface that is clingy and traps foreign matter; that is difficult to rinse. It is known or obvious to a person skilled in the art that this does not require the strand of the present invention to maintain an equal measure in diameter throughout the length of the strand. For example, alternate strands may have a top end that is larger than the bottom end, a bottom end that is larger than the top end, a middle portion that is larger than the top and bottom end, a middle portion that is smaller than the bottom and top end; or any similar combination of the above FIG. 9. The present invention may comprise a strand that is microtextured. An overall smooth solid strand reinforces an objective of the invention; to provide an implement that is easier to rinse and reuse.

The perimeter created by the diameters of strand 102 forms a circular shape. Alternate embodiments of the present invention may comprise a strand whose perimeter is rectangular, oval or made up of any number of angles.

Generally, the top end of the strand is mostly rounded. Alternate embodiments of the present invention may comprise a strand with a nonabrasive top end that is not rounded. For example, the top end of the strand may form a perceptible concave shape. The top end of the present invention's strand may also be slightly frayed or fringed; to a degree that remains within the overall scope of the invention and does not result in an implement with poor reusability characteristics.

Strand 102 is soft, pliable and semiresilient; as to provide a gentle nonabrasive effect during application; comparable to men's synthetic shaving brushes or synthetic cosmetic brushes. A pliable strand also minimizes or eliminates the probability of foreign matter; such as hair, to wrap around and entangle itself on the strands. The described strand is effectively pliable; to support the already mentioned examples of how implement 100 can be rinsed and reused; with water sprayed from a nozzle or by rubbing implement 100 between two hands under running water. Strand 102 further improves the lathering qualities of implement 100; an objective of the present invention, allowing the intended user to comfortably produce a lather during a showering or bathing application.

It is an objective for the strand of the present invention not to capture or cling to dirt, soil, skin and hairs. Prior art, U.S. Pat. No. 6,085,380 (Gonda), U.S. Pat. No. 8,500,211B2 (Lindblad), U.S. Pat. No. 6,305,431B1 (Fenkes), U.S. Pat. No. 8,156,967B2 (Huffstickler), are examples of inventions that are contrary to the spirit of the present invention; containing elements that amplify the ability to cling to foreign matter.

The strand of the present invention is restricted to a length equal to or less than about 1 inch and a diameter equal to or less than about 1 inch. Strands are sufficiently numbered and arranged to form an effective and useful surface within the scope of the invention. Strands cannot be spaced more than about 1 inch from one another on any surface of the backing comprised of strands. Embodiments can apply the strand spacing measurement restriction to a single various sized area located on a surface of the backing or multiple variously sized areas positioned separately from one another within the boundaries of a particular surface of the backing.

The backing of the present invention; as described, allows a person skilled in the pertinent art to make various changes to the length, diameter, top end and spacing of the strand; while remaining within the spirit of the invention.

It is preferred strand 102 is a cylindrical monofilament with an uncompressed length of 5 mm, a continuous uncompressed diameter of 1 mm and a rounded top end; spaced at 16 strands per square inch.

FIG. 1, is shown tether 112 attached to implement 100. Tether 112 improves the handling characteristics of implement 100 and provides a method to hang the implement. Alternate embodiments of the present invention may also include a means to adjust the size of the tether's loop opening; or exclude a tether altogether.

Embodiments of the present invention may also include a means that extends from; or is connected to, one or more points of the implement which would allow for other alternative methods to handle the device during use. For example, the means may; or may not, form one or more openings that enable the user to secure the implement to one's hand or finger(s); or backings and handles of various size. It is preferred the means is formed above a main surface of the device not comprised of strands or incorporated in a way that avoids creating an area between the means, backing and strands that may trap foreign matter (Gilman). Embodiments may also be comprised to include a second separate means that can adjust the size of the opening(s) created by the first means in order to further secure or fasten the implement.

Figure 6:
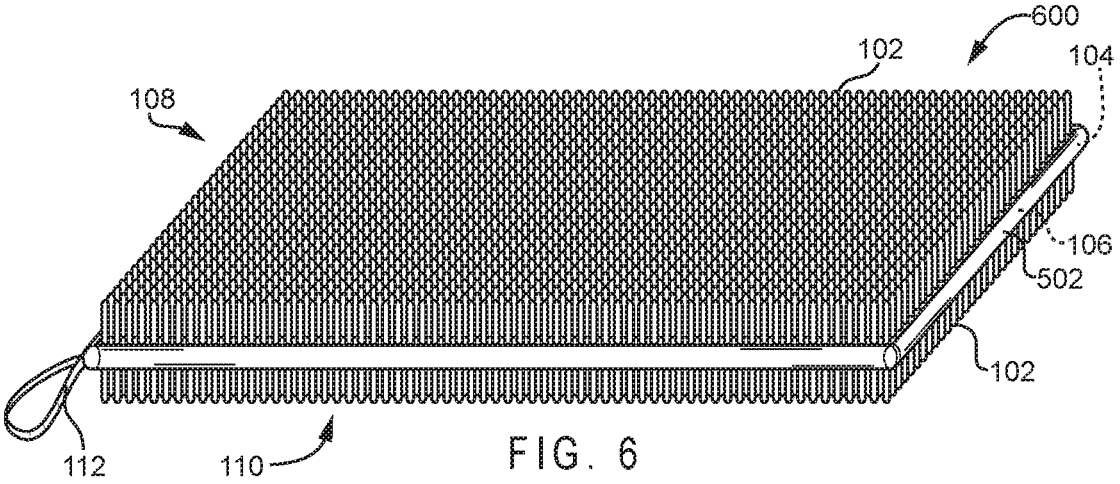
FIG. 6. Is a perspective top view of an alternate embodiment of the invention.

FIG. 6, there is shown an alternate embodiment of the present invention; indicated as implement 600, which incorporates lining 502 wrapped around perimeter 106. Lining 502 is provided as a means to resolve issues or concerns that may be contrary to the spirit of the invention; arising from a certain method of construction and assembly of implement 600 or alternate embodiments of the present invention. For example, lining 502 may serve as a means to secure the edges or ends of two individual backings that are connected together to form a single backing; or smooth the abrasive edges of a single backing that is formed by two backings that are secured together. Lining 502 can also serve to smooth the abrasive edges of a molded backing; or smooth a perimeter that may be abrasive due to the method in which the backing is cut from a larger piece of material. The present invention does not limit lining 502 to a specific application. It is preferred that lining 502 maintains the flat surface of the backing as described and remains within the overall scope of the invention.

There are a variety of materials that may fulfill the requirements of the present invention. For example, the backing may be comprised of common polymers such as polyethylene or polypropylene; while the strands and lining may be comprised of a synthetic material such as nylon. The invention does not limit any element or component to a specific material. It is preferred the material chosen is hypoallergenic; has tolerances which allow it to be exposed to household soaps, detergents and bleach; machine washable; and machine dryable. The providing of example materials is intended to serve as an aid to better understand and grasp the scope of the invention; not limit the present invention to any one specific material.

The scope of the present invention also contemplates the option of incorporating material coatings and or finishes in certain embodiments as to further enhance their efficacy.

It is understood that the various methods to assemble the components comprising the present invention are a routine detail and the essence of the invention has been described so that any person in the relevant field can fabricate said invention without extensive experimentation.

While the described invention originated from addressing problems associated with handheld implements intended for showering and bathing it is understood this does not limit the invention to a specific application. The aforementioned description contemplates any alternative use that may benefit from the present invention; such as a dusting and or wiping application. It is also obvious that while embodiments of the present invention have been illustrated and described it is apparent to those skilled in the art various changes may be made without departing from the spirit and scope of the invention; and it is intended all such compliant modifications are contained within the specification and the appended claims.

What is claimed is:

1. A reusable handheld implement comprised of:

a single backing, multiple strands and a perimeter;

(A) the backing is mostly flat and made of a water resistant or waterproof material; the mentioned backing is perforated, allowing the backing to be permeable; and where the backing has a thickness that minimizes the volume of said perforations;

and, (1) the backing is pliable, (2) perforations are located throughout the backing, (B) the strands are soft and not opened looped; the mentioned strands have an overall smooth surface; the strands are connected to or extend from the backing in a manner that allows each strand to have a top end that is vertical or vertically aligned to its bottom end;

and, (1) the strands are pliable, (2) the length of each individual strand is not greater than about 1 inch, (3) the diameter of each individual strand is not greater than about 1 inch, (4) the strands are not spaced more than about 1 inch apart on any surface of the backing comprised of said strands.

2. The reusable handheld implement of claim 1, wherein the backing is semirigid.

3. The reusable handheld implement of claim 1, wherein the backing is semiresilient.

4. The reusable handheld implement of claim 1, wherein the perforations are adjacent to the strands.

5. The reusable handheld implement of claim 1, wherein the strands are solid.

6. The reusable handheld implement of claim 1, wherein the strands are mostly linear.

7. The reusable handheld implement of claim 1, wherein the strands are semiresilient.

8. The reusable handheld implement of claim 1, wherein the perimeter is nonabrasive.

9. The reusable handheld implement of claim 1, wherein the length of the implement is not greater than about 15 inches and not less than about 3 inches.

10. The reusable handheld implement of claim 1, wherein the width of the implement is not greater than about 15 inches and not less than about 3 inches.

11. The reusable handheld implement of claim 1, wherein the diameter of the implement is not greater than about 1 inch.

12. The reusable handheld implement of claim 1, may further comprise a tether attached to the implement.

13. The reusable handheld implement of claim 1, may further comprise a lining attached to the implement.

14. The reusable handheld implement of claim 1, may further comprises a means extending from; or connected to, one or more points of the implement allowing for alternate methods to handle and use the implement.

15. A reusable handheld implement comprised of:

a single backing, multiple strands, and a perimeter;

(A) the backing is mostly flat and made of a water resistant or waterproof material; the mentioned backing is perforated, allowing the backing to be permeable; and where the backing has a thickness that minimizes the volume of said perforations;

and, (1) the backing is semirigid, pliable and semiresilient, (2) perforations are located throughout the backing, (3) perforations are adjacent to the strands, (B) the strands are soft, solid, mostly linear and not open looped; the mentioned strands have an overall smooth surface; the strands are connected to or extend from the backing in a manner that allows each strand to have a top end that is vertical or vertically aligned to its bottom end;

and, (1) the strands are pliable and semiresilient, (2) the length of each individual strand is not greater than about 1 inch, (3) the diameter of each individual strand is not greater than about 1 inch, (4) the strands are not spaced more than about 1 inch apart on any surface of the backing comprised of said strands, (C) the perimeter is nonabrasive, (D) the length of the implement is not greater than about 15 inches and not less than about 3 inches, (E) the width of the implement is not greater than about 15 inches and not less than about 3 inches, (F) the diameter of the implement is not greater than about 1 inch.

16. The reusable handheld implement of claim 15, may further comprise a tether attached to the implement.

17. The reusable handheld implement of claim 15, may further comprise a lining attached to the implement.

18. The reusable handheld implement of claim 15, may further comprise a means extending from; or connected to, one or more points of the implement allowing for alternate methods to handle and use the implement.

* * * * *